US006808124B2

(12) United States Patent
Egler

(10) Patent No.: US 6,808,124 B2
(45) Date of Patent: Oct. 26, 2004

(54) FUEL INJECTION SYSTEM FOR AN INTERNAL COMBUSTION ENGINE

(75) Inventor: Walter Egler, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 140 days.

(21) Appl. No.: 10/303,703

(22) Filed: Nov. 26, 2002

(65) Prior Publication Data

US 2003/0101968 A1 Jun. 5, 2003

(30) Foreign Application Priority Data

Nov. 30, 2001 (DE) ..... 101 58 659

(51) Int. Cl.[7] ..... F02M 47/02

(52) U.S. Cl. ..... 239/88; 239/91; 239/89; 239/124; 239/533.2; 123/446

(58) Field of Search ..... 239/88–92, 96, 239/124, 533.2, 533.3, 533.9; 123/446, 467

(56) References Cited

U.S. PATENT DOCUMENTS 5,443,047 A * 8/1995 Ishiwata et al. ..... 123/446
5,622,152 A * 4/1997 Ishida ..... 123/446
5,826,561 A * 10/1998 Mack et al. ..... 123/446

FOREIGN PATENT DOCUMENTS

| | | |
|---|---|---|
| DE | 41 18 236 A1 | 12/2001 |
| EP | 0 840 003 A1 | 5/1998 |
| WO | WO 01/14724 A1 | 3/2001 |

* cited by examiner

*Primary Examiner*—Dinh Q. Nguyen
(74) *Attorney, Agent, or Firm*—Ronald E. Greigg

(57) ABSTRACT

The fuel injection system has one high-pressure fuel pump and one fuel injection valve for each cylinder of the engine. A pump work chamber can be made to communicate with a pressure chamber of the injection valve which has a valve member movable in an opening direction by the pressure in the pressure chamber, counter to a closing force. A first control valve, controls a communication of the work chamber with a relief chamber, and a second control valve, controls the pressure prevailing in a control pressure chamber urging the injection valve closed. In a first switching position of the first control valve the work chamber is made to communicate with the relief chamber, while the pressure chamber and the control pressure chamber are disconnected from the work chamber, and for a second switching position, the work chamber is disconnected from the relief chamber by the first control valve, while the pressure chamber and the control pressure chamber communicate with the work chamber.

30 Claims, 3 Drawing Sheets

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Prior Art

One fuel injection system of the type with which this invention is concerned, known from European Patent Disclosure EP 0 957 261 A1, has one high-pressure fuel pump and one fuel injection valve, communicating with it, for each cylinder of the engine. The high-pressure fuel pump has a pump piston, driven in a reciprocating motion by the engine, and this piston defines a pump work chamber that can be made to communicate with a pressure chamber of the fuel injection valve, which valve has an injection valve member by which at least one injection opening is controlled and which is movable by the pressure prevailing in the pressure chamber, counter to a closing force, in an opening direction to uncover the at least one injection opening. A first electrically actuated control valve is provided, which can be switched back and forth between two switching positions and by which a communication of the pump work chamber with a relief chamber is controlled. A second electrically actuated control valve is also provided, by which the pressure prevailing in a control pressure chamber is controlled, by which pressure the injection valve member is urged in the closing direction. The control pressure chamber has a communication with the pump work chamber, and by means of the second control valve, a communication of the control pressure chamber with a relief chamber is controlled. A disadvantage of this known fuel injection system is that the course of the fuel injection, or in other words the injected fuel quantity and the pressure at which the fuel injection is effected, can vary to only a limited extent during an injection cycle. In particular, in an injection cycle with a preinjection and a subsequent main injection, the pressure at which the main injection begins, and the spacing between the main injection and the preinjection are coupled with one another and are not freely variable. If the main injection is meant to begin at a slight pressure, then the spacing from the preinjection is only slight, and if the main injection is meant to begin at a high pressure, then the spacing from the preinjection is long.

OBJECT AND SUMMARY OF THE INVENTION

The fuel injection system of the invention has the advantage over the prior art that by means of the first control valve, in its first switching position, an elevated pressure can be maintained in the pressure chamber and in the control pressure chamber, even when the pump work chamber is in communication with the relief chamber, so that regardless of a relief of the pump work chamber by means of the second control valve, a fuel injection can be controlled, particularly for a preinjection and/or a postinjection. The pressure buildup for a main injection can be controlled by the first control valve, and the instant at which the main injection begins can be controlled by the second control valve. This makes a decoupling possible between the pressure at which the main injection begins and the spacing from a preceding preinjection.

Other advantageous features and refinements of the fuel injection system of the invention are disclosed. One embodiment enables a simultaneous relief of the pump work chamber, the pressure chamber and the control pressure chamber. Another embodiment makes a control of the pressure in the control pressure chamber possible in a simple way, while another enables adjusting the fuel inflow into the control pressure chamber and the fuel outflow from the control pressure chamber. A further embodiment makes it possible to operate the engine with low noise and pollutant emissions while another, in a simple way, enables adjusting the fuel quantity for the preinjection by means of the length of time for which the first control valve is closed. Further embodiments make it possible in a simple and purely mechanical way to adjust the fuel quantity for the preinjection, enables a postinjection, without fuel having to be pumped by the pump piston during the postinjection, makes it possible in a simple way to perform a preinjection, and enables a relief of the pressure chamber and of the control pressure chamber.

BRIEF DESCRIPTION OF THE DRAWINGS

The invention will be better understood and further objects and advantages thereof will become more apparent from the ensuing detailed description of preferred embodiments taken in conjunction with the drawings, in which.

DESCRIPTION OF THE PREFERRED EMBODIMENTS

Figure 1:
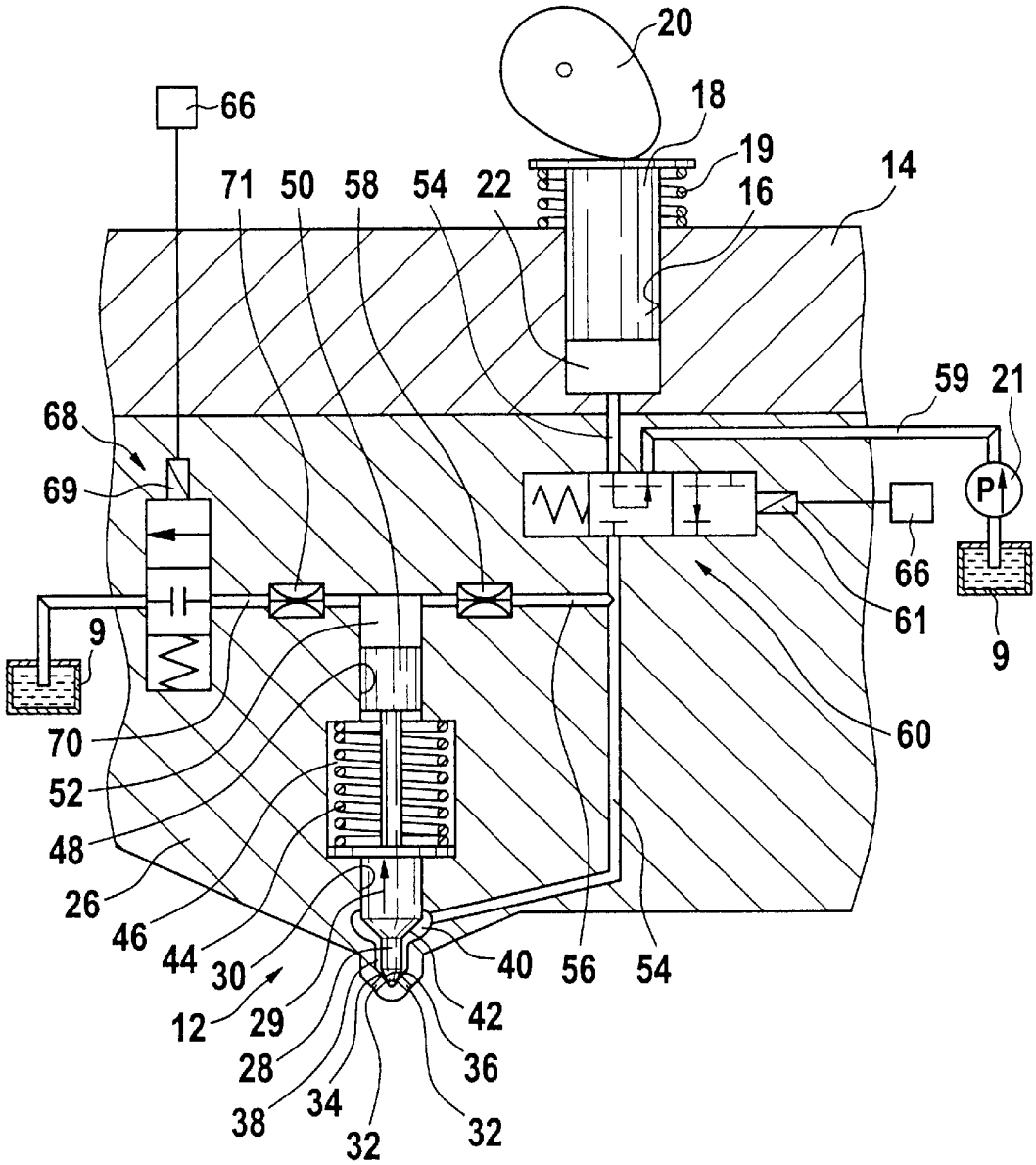
FIG. 1 schematically shows a fuel injection system for an internal combustion engine in terms of a first exemplary embodiment.
Figure 2:
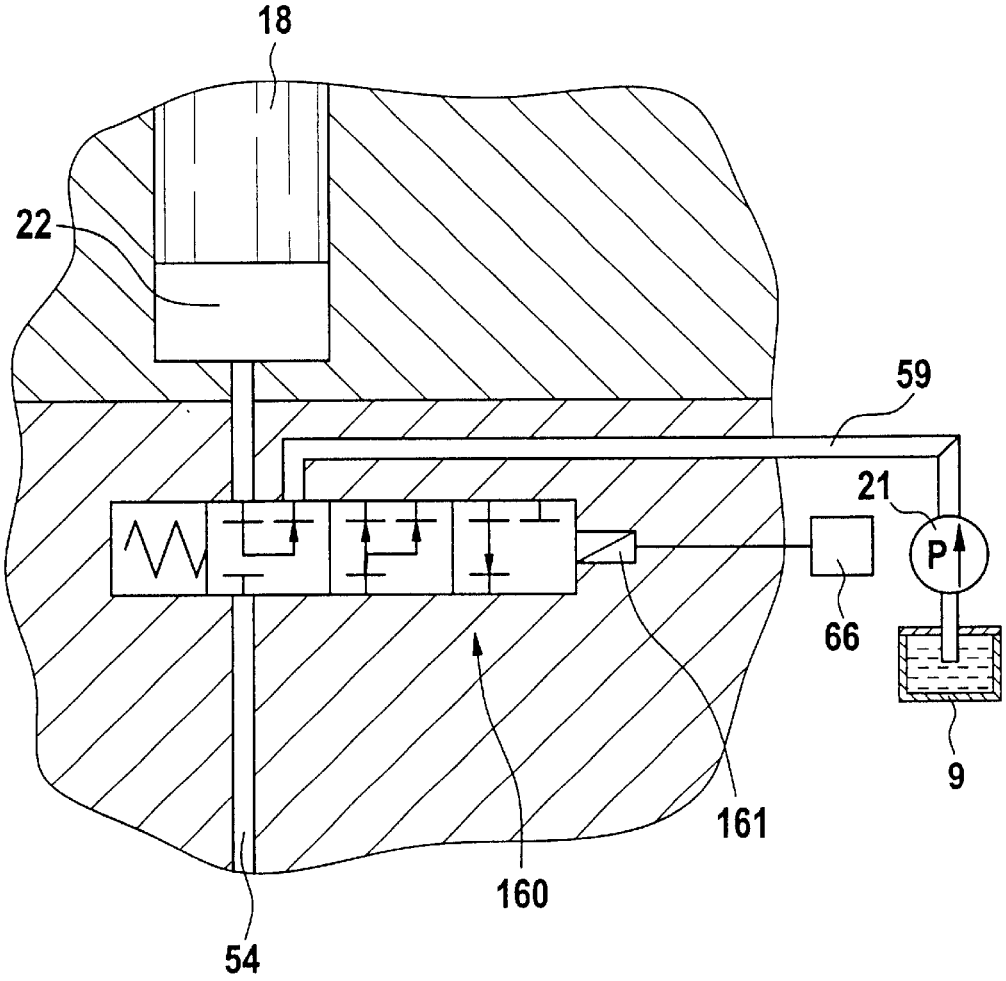
FIG. 2 shows the fuel injection system in detail, in a second exemplary embodiment.

In FIGS. 1 and 2, a fuel injection system for an internal combustion engine of a motor vehicle is shown. The engine is preferably a self-igniting internal combustion engine. The fuel injection system is preferably embodied as a so-called unit fuel injector system, and for each cylinder of the engine has one high-pressure fuel pump 10 and one fuel injection valve 12, communicating with the pump and combined into a structural unit. Alternatively, the fuel injection system can also be embodied as a so-called pump-line-nozzle system, in which once again the high-pressure fuel pump 10 and the fuel injection valve 12 are provided for each cylinder of the engine, but are disposed spaced apart from one another and communicate with one another via a line. The high-pressure fuel pump 10 has a pump piston 18, guided tightly in a cylinder bore 16 of a pump body 14, and this pump piston is driven in a reciprocating motion by a cam 20 of an engine camshaft, either directly or via a transmission element, such as a tilt lever, counter to the force of a restoring spring 19. In the cylinder bore 16, the pump piston 18 defines a pump work chamber 22, in which fuel at high pressure is compressed in the pumping stroke of the pump piston 18. Fuel from a fuel tank 9 of the motor vehicle is delivered to the pump work chamber 22 by means of the feed pressure of a feed pump 21.

The fuel injection valve 12 has a valve body 26, connected to the pump body 14, which can be embodied in multiple parts and in which an injection valve member 28 is guided longitudinally displaceably in a bore 30. On its end region toward the combustion chamber of the cylinder of the engine, the valve body 26 has at least one and preferably a plurality of injection openings 32. The injection valve member 28, in its end region toward the combustion chamber, has a sealing face 34, which for instance is approximately conical, and which cooperates with a valve seat 36, embodied in the valve body 26 in its end region toward the combustion chamber, from which seat, or downstream of which, the injection openings 32 lead away. There is an annular chamber 38 in the valve body 26, between the injection valve member 28 and the bore 30, toward the valve seat 36, and this chamber, in its end region remote from the valve seat 36, merges through a radial widening of the bore 30 with a pressure chamber 40 surrounding the injection valve member 28. At the level of the pressure chamber 40, as a result of a cross-sectional reduction, the injection valve member 28 has a pressure shoulder 42. A prestressed closing spring 44 engages the end of the injection valve member 28 remote from the combustion chamber, and by means of this spring the injection valve member 28 is pressed toward the valve seat 36. The closing spring 44 is disposed in a spring chamber 46 of the valve body 26 that adjoins the bore 30.

Adjoining the spring chamber 46, on its end in the valve body 26 remote from the bore 30, is a further bore 48, in which a piston 50 that is connected to the injection valve member 28 is guided tightly. The piston 50, with its face end remote from the injection valve member 28, defines a control pressure chamber 52. The pressure chamber 40 has a communication 54 with the pump work chamber 22, which communication is formed by a conduit extending through the pump body 14 and the valve body 26. The communication 54 will hereinafter be called the pressure chamber communication 54. From the pressure chamber communication 54, a communication 56 with the control pressure chamber 52 branches off, so that the control pressure chamber 52 likewise communicates with the pump work chamber 22. The communication 56 will hereinafter be called the control pressure chamber communication 56.

The fuel injection system has a first electrically actuated control valve 60, by which a communication 59 of the pump work chamber 22 with a relief chamber is controlled; the compression side of the feed pump 21 and thus at least indirectly the fuel tank 9 can serve as this relief chamber. The communication 59 will hereinafter be called the relief chamber communication 59. The first control valve 60 is disposed upstream of the control pressure chamber communication 56, leading to the control pressure chamber 52, in the pressure chamber communication 54.

The first control valve 60 has an actuator 61, which may be an electromagnet or a piezoelectric actuator, which is triggered electrically and by which a valve member of the control valve 60 is movable. The first control valve 60 can be embodied as either pressure-equalized or non-pressure-equalized. In a first exemplary embodiment, shown in FIG. 1, the first control valve 60 is embodied as a 3/2-port directional-control valve, which can be switched back and forth between two switching positions. By means of the first control valve 60, in a first switching position, the relief chamber communication 59 with the relief chamber 9 is opened, so that the pump work chamber 22 communicates with the relief chamber 9, while the pressure chamber 40 and the control pressure chamber 52 are disconnected from the pump work chamber 22. In a second switching position, by means of the first control valve 60, the relief chamber communication 59 with the relief chamber 9 is disconnected, so that the pump work chamber 22 is disconnected from the relief chamber 9, while the pressure chamber 40 and the control pressure chamber 52 communicate with the pump work chamber 22. The first control valve 60 is switched between its two switching positions by an electric control unit 66 as a function of engine operating parameters.

For controlling the pressure in the control pressure chamber 52, a second electrically actuated control valve 68 is provided, by which a communication 70 of the control pressure chamber 52 with a relief chamber, for instance at least indirectly the fuel tank 9, is controlled. The communication 70 will hereinafter be called the relief chamber communication 70. The second control valve 68 has an actuator 69, which may be an electromagnet or a piezoelectric actuator and which is triggered electrically, and by which a valve member of the control valve 68 is movable. The second control valve 68 is preferably embodied as pressure-balanced. The second control valve 68 is embodied as a 2/2-port directional-control valve, by which in a first switching position, the relief chamber communication 70 of the control pressure chamber 52 with the relief chamber 9 is opened, and by which in a second switching position, the relief chamber communication 70 of the control pressure chamber 52 with the relief chamber 9 is disconnected. A throttle restriction 58 is provided in the control pressure chamber communication 56 of the control pressure chamber 52 with the pressure chamber communication 54, and a further throttle restriction 71 is provided in the relief chamber communication 70 of the control pressure chamber 52 with the relief chamber 9. Selection of the throttle restrictions 58, 71 makes it possible to adjust the inflow of fuel into the control pressure chamber 52 and the outflow of fuel from the control pressure chamber 52. The second control valve 68 is likewise controlled by the control unit 66. The control of the control valves 60, 68 by the control unit 66 is effected as a function of engine operating parameters, such as rpm, load, and temperature.

The function of the fuel injection system will now be explained. In the intake stroke of the pump piston 18, fuel is delivered to the pump work chamber 22 by the feed pump 21, with the first control valve 60 in its first switching position, in which the pump work chamber 22 communicates with the feed pump 21 and is disconnected from both the pressure chamber 40 and the control pressure chamber 52. In the pumping stroke of the pump piston 18, a fuel injection takes place in an injection cycle. The injection cycle begins with a preinjection, in which a slight fuel quantity is injected, at a relatively slight pressure. At the onset of the pumping stroke of the pump piston 18, the first control valve 60 is put into its second switching position by the control unit 66, so that the pump work chamber 22 is disconnected from the relief chamber 9, and the pressure chamber 40 and the control pressure chamber 52 communicate with the pump work chamber 22. The second control valve 68 is closed by the control unit 66. Fuel is then pumped by the pump piston 18 into the pressure chamber 40 and the control pressure chamber 52. The fuel injection valve 12 remains closed during this process, because of the pressure prevailing in the control pressure chamber 52 when the second control valve 68 is closed. After a certain length of time, the control unit 66 puts the first control valve 60 in its first switching position, so that the pump work chamber 22 communicates with the relief chamber 9, and the pressure chamber 40 and the control pressure chamber 52 are disconnected from the pump work chamber 22. Fuel thus continues to be stored under pressure in the pressure chamber 40 and the control pressure chamber 52. At a predetermined instant, the control unit 66 opens the second control valve 68, so that the control pressure chamber 52 is relieved, and the injection valve member 28 opens in response to the pressure prevailing in the pressure chamber 40. The valve member is effected at the pressure level at which the fuel is stored in the pressure chamber 40. For terminating the preinjection, the second control valve 68 is closed again by the control unit 66, so that the injection valve member 28 closes as a consequence of the increased pressure in the control pressure chamber 52. It is also possible for a plurality of preinjections to be effected at intervals from one another by correspondingly opening and closing the second control valve 68.

Figure 3:
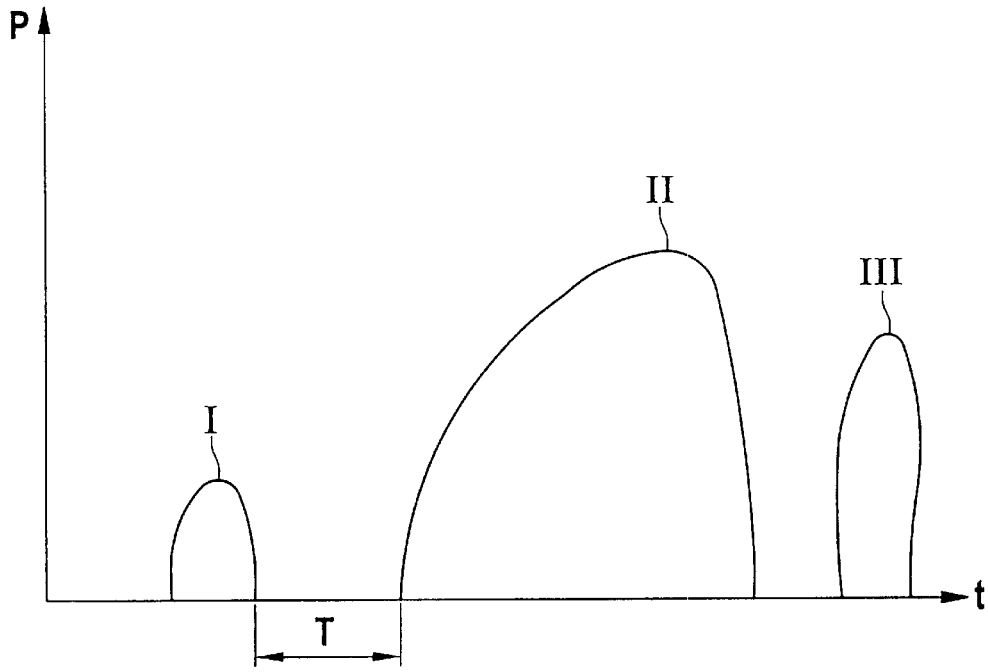
FIG. 3 shows a course of a pressure at injection openings of a fuel injection valve of the fuel injection system during one injection cycle.

In FIG. 3, the course of the pressure p at the injection openings 32 of the fuel injection valve 12 is plotted over the time t during one injection cycle. The preinjection corresponds to an injection phase marked I in FIG. 3.

Alternatively, for the preinjection it can also be provided that the first control valve 60 is put in its second switching position at the onset of the pumping stroke of the pump piston 18 by the control unit 66, so that with the second control valve 68 closed, the pump piston 18 pumps fuel into the pressure chamber 40 and the control pressure chamber 52. At a certain instant, when a certain fuel quantity has been pumped into the pressure chamber 40 and the control pressure chamber 52 by the pump piston 18, the first control valve 60 is put in its first switching position by the control unit 66, so that the pump work chamber 22 is relieved, and the pressure chamber 40 and the control pressure chamber 52 are disconnected from the pump work chamber 22, and fuel continues to be stored under pressure in the pressure chamber 40 and in the control pressure chamber 52. At a predetermined instant, the control unit 66 opens the second control valve 68, so that the control pressure chamber 52 is relieved, and the injection valve member 28 opens in response to the pressure prevailing in the pressure chamber 40. The preinjection is terminated when the pressure in the pressure chamber 40 has dropped so sharply that the force exerted on the injection valve member 28 by the closing spring 44 is greater than the force exerted in the opening direction on the injection valve member 28 by the pressure prevailing in the pressure chamber 40, and the injection valve member 28 closes.

As a further alternative, it can be provided that fuel is still stored in the pressure chamber 40 and in the control pressure chamber 52, from a preceding injection cycle with the second control valve 68 closed, at a pressure which is sufficiently high to perform a preinjection by opening the second control valve 68. At the onset of the pumping stroke of the pump piston 18, the first control valve 60 can remain in its first switching position, since no fuel needs to be pumped into the pressure chamber 40 and the control pressure chamber 52. The preinjection is terminated by the closure of the second control valve 68 and/or if the pressure in the pressure chamber 40 has dropped so much that the injection valve member 28 is closed by the closing spring 44.

Figure 4:
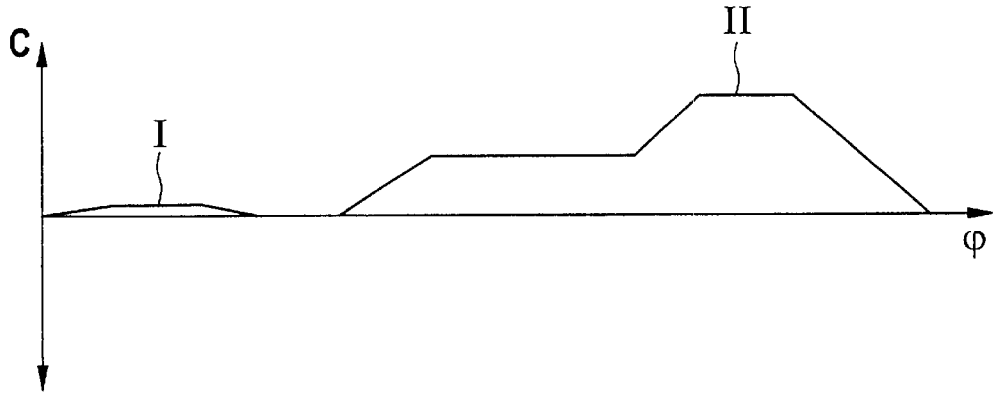
FIG. 4 shows the course of the speed of a pump piston in the fuel injection system during one injection cycle.

As still another alternative, it may be provided that the first control valve 60 is put in its second switching position by the control unit 66 at the onset of the pumping stroke of the pump piston 18, so that the pump work chamber 22 is disconnected from the relief chamber 9 and communicates with the pressure chamber 40 and the control pressure chamber 52. The cam 20 has a shape such that by it, over a first rotational angle range, a pumping stroke of the pump piston 18 is accomplished, so that by the pump piston 18, fuel is pumped into the pressure chamber 40 and the control pressure chamber 52 while the second control valve 68 is closed. In an ensuing rotational angle range of the cam 20, this cam is shaped such that no further pumping stroke of the pump piston 18 occurs. The speed C of the pump piston 18 in its reciprocating motion, effected by the cam 20, over the rotational angle $\phi$ of the cam 20 is shown in FIG. 4; the speed in the stroke effected by the first rotational angle range is marked I, while the speed in the ensuing rotational angle range of the cam 20 is zero, and the speed in a stroke accomplished by a further rotational angle range of the cam 20 during a main injection is marked II. By means of the shape of the cam 20 in the first rotational angle range and by means of the resultant stroke of the pump piston 18, the fuel quantity that is pumped by the pump piston 18 into the pressure chamber 40 and the control pressure chamber 52 is determined. For the preinjection, the second control valve 68 is opened by the control unit 66, and the preinjection is terminated when the second control valve 68 is closed and/or when the pressure in the pressure chamber 40 has dropped so sharply that the injection valve member 28 is closed by the force of the closing spring 44.

After the preinjection, the first control valve 60 is put in its second switching position by the control unit 66, and the second control valve 68 is closed by the control unit 66. In the pumping stroke of the pump piston 18, high pressure is built up in the pressure chamber 40 and in the control pressure chamber 52, but no injection can yet occur, as long as the second control valve 68 is still closed and high pressure still prevails in the control pressure chamber 52. Once a predetermined pressure, at which the main injection is meant to begin, is reached in the pressure chamber 40, the control unit 66 opens the second control valve 68, so that the control pressure chamber 52 is relieved. The injection valve member 28 then opens in response to the pressure prevailing in the pressure chamber 40, and the main injection begins. The main injection corresponds to an injection phase marked II in FIG. 3. For terminating the main injection, the second control valve 68 is closed by the control unit 66, so that the control pressure chamber 52 is disconnected from the relief chamber 9, and a high pressure builds up in the control pressure chamber 52, by which pressure the injection valve member 28 is closed. Additionally, upon termination of the main injection, the first control valve 60 can also be put in its first switching position by the control unit 66.

By varying the instant of opening of the second control valve 68 by means of the control unit 66, the pressure at which the main injection begins is also varied. The earlier the second control valve 68 is opened, the less is the pressure at which the main injection begins. The later the second control valve 68 is opened, the higher is the pressure at which the main injection begins. Because of the kinds of preinjection procedures explained above, it is possible, in the event of a variation of the pressure at which the main injection begins, to vary the spacing T between the preinjection and the main injection independently of this pressure. The pressure buildup for the main injection is controlled by the first control valve 60. If the main injection is to begin at high pressure, then the first control valve 60 is switched over from its first switching position to its second switching position by the control unit 66, at an early instant after the preinjection, so that a pressure buildup takes place. The spacing of the main injection from the preinjection is determined by the instant of opening of the second control valve 68 by the control unit 66. If the main injection is to begin at a slight pressure, then the first control valve 60 is closed by the control unit 66 at a later instant after the preinjection, so that a correspondingly delayed pressure buildup takes place. The spacing of the main injection from the preinjection is determined once again by the instant of opening of the second control valve 68.

Alternatively, it can also be provided that the second control valve 68 is already opened by the control unit 66 before the main injection begins, so that the control pressure chamber 52 is relieved. The first control valve 60 is put in its second switching position by the control unit 66, and the main injection begins when the pressure in the pressure chamber 40 is so high that this pressure opens the injection valve member 28 counter to the force of the closing spring 44. For terminating the main injection, the second control valve 68 is closed by the control unit 66, and/or the first control valve 60 is put in its first switching position.

After the main injection, at least one postinjection can also take place. After the termination of the main injection, fuel can be stored in the pressure chamber 40 and in the control pressure chamber 52 while the second control valve 68 is closed and the first control valve 60 is in its first switching position. The level of the pressure at which the fuel is stored is determined by the instant of closure of the second control valve 68 upon the termination of the main injection. The earlier the second control valve 68 is closed, the higher is the pressure at which the fuel is stored in the pressure chamber 40 and in the control pressure chamber 52. For a postinjection, the second control valve 68 is opened again by the control unit 66, so that the control pressure chamber 52 is relieved again and the injection valve member 28 opens. The postinjection is equivalent to an injection phase marked III in FIG. 3. The postinjection is terminated by the closure of the second control valve 68 by the control unit 66. It is also possible for a plurality of successive postinjections to take place. The fuel injected in the postinjection need not be pumped by the pump piston 18 at the instant of the postinjection but instead is withdrawn from the pressure chamber 40 and the control pressure chamber 52, into which the fuel had already been pumped by the pump piston 18 in an earlier phase of the pumping stroke of the pump piston. The first control valve 60 can remain in its first switching position after the termination of the main injection.

For the postinjection, alternatively, the first control valve 60 can also be put in its second switching position by the control unit 66, so that fuel is pumped into the pressure chamber 40 by the pump piston 18. If fuel from the preceding main injection is still stored in the pressure chamber 40 and the control pressure chamber 52, then only some of the fuel quantity required for the postinjection has to be pumped by the pump piston 18 during the postinjection. If with the second control valve 68 open and the control pressure chamber 52 thus relieved the pressure in the pressure chamber 40 is high enough that the opening force on the injection valve member 28 is greater than the closing force acting on it, the postinjection begins. The postinjection is terminated by the closure of the second control valve 68 by the control unit 66 and/or if the pressure in the pressure chamber 40 has dropped so sharply that the closing force on the injection valve member 28 is greater than the opening force, generated by the pressure in the pressure chamber 40, and the injection valve member 28 closes.

After the termination of the postinjection or the main injection, if no postinjection is contemplated, fuel can still be stored under pressure in the pressure chamber 40 and in the control pressure chamber 52, with which fuel, a preinjection can be effected in the ensuing injection cycle, as indicated above. This requires effective sealing of the pressure chamber 40 and the control pressure chamber 52, so that there will be no substantial pressure drop from leakage. At low engine rpm, when the duration of an injection cycle is correspondingly long, the pressure in the pressure chamber 40 and in the control pressure chamber 52 can drop sharply because of leakage, but the pressure is preferably kept at least at the pressure level generated by the feed pump 21. It may also be provided that to terminate the main injection or the postinjection, the second control valve 68 is closed by the control unit 66 and remains closed until such time as the pressure in the pressure chamber 40 has dropped from leakage so sharply that the injection valve member 28 can no longer open, even when the second control valve 68 is open. Next, the second control valve 68 is briefly opened, so that the pressure chamber 40 and the control pressure chamber 52 are relieved.

In FIG. 2, the fuel injection system is shown in a second exemplary embodiment, in which compared to the first exemplary embodiment only the embodiment of the first control valve 160 is modified. The first control valve 160 is embodied as a 3/3-port directional-control valve and can be switched among three switching positions. In a first switching position of the control valve 160, the pump work chamber 22 is made by the control valve to communicate with the feed pump 21 or the relief chamber 9, and the pressure chamber 40 and the control pressure chamber 52 are disconnected from the pump work chamber 22. In a second switching position of the control valve 160, this valve disconnects the pump work chamber 22 from the feed pump 21 or the relief chamber 9 and causes the pressure chamber 40 and the control pressure chamber 52 to communicate with the pump work chamber 22. In a third switching position of the control valve 160, by means of it the pump work chamber 22 communicates with the feed pump 21 or the relief chamber 9, and the pressure chamber 40 and the control pressure chamber 52 likewise communicate with the feed pump 21 or the relief chamber 9. The first switching position of the control valve 160 thus has the same function as the first switching position of the control valve 60 of the first exemplary embodiment, and the second switching position of the control valve 160 has the same function as the second switching position of the control valve 60 of the first exemplary embodiment. The mode of operation, explained above in conjunction with the first exemplary embodiment, of the fuel injection system can thus also be achieved with the control valve 160 of the second exemplary embodiment. With the third switching position of the control valve 160, a relief of the pump work chamber 22 and also of the pressure chamber 40 and the control pressure chamber 52 is made possible. It may be provided that for terminating a fuel injection, that is, the preinjection and/or the main injection and/or the postinjection, the first control valve 160 is put in its third switching position by the control unit 66, as a result of which a rapid relief of the pressure chamber 40 and the control pressure chamber 52 is achieved, and thus also a fast closure of the injection valve member 28 for terminating the fuel injection. For switching over the first control valve 160, it may be provided that its actuator 161 is supplied with current at different current levels by the control unit 66. When the actuator 161 is without current, the control valve 160 is in its first switching position; when the actuator 161 is supplied with an elevated current level, the control valve 160 is switched over to its third switching position; and when the actuator 161 is supplied with a still further-increased current level, the control valve 160 is switched over to its second switching position.

The foregoing relates to preferred exemplary embodiments of the invention, it being understood that other variants and embodiments thereof are possible within the spirit and scope of the invention, the latter being defined by the appended claims.

I claim:

1. A fuel injection system for an internal combustion engine, comprising one high-pressure fuel pump (10) and one fuel injection valve (12) communicating with the high pressure pump for each cylinder of the engine, the high-pressure fuel pump (10) having a pump piston (18) driven by the engine in a reciprocating motion and defining a pump work chamber (22) that can be made to communicate with a pressure chamber (40) of the fuel injection valve (12), the fuel injection valve (12) having an injection valve member (28) by which at least one injection opening (32) is controlled and which is movable, by the pressure prevailing in the pressure chamber (40), counter to a closing force (44) in an opening direction (29) for uncovering the at least one injection opening (32), a first electrically actuated control valve (60; 160), which can be switched back and forth between at least two switching positions and by which at least indirectly a communication (59) of the pump work chamber (22) with a relief chamber (9; 21) is controlled, and a second electrically actuated control valve (68), by which the pressure prevailing in a control pressure chamber (52) is controlled, by which pressure the injection valve member (28) is urged at least indirectly in the closing direction, the pump work chamber (22) communicating with the relief chamber (9; 21), while the pressure chamber (40) and the control pressure chamber (52) are disconnected from the pump work chamber (22) in a first switching position of the first control valve (60; 160), and the pump work chamber (22) is disconnected from the relief chamber (9; 21), while the pressure chamber (40) and the control pressure chamber (52) communicate with the pump work chamber (22) that in a second switching position of the first control valve (60; 160).

2. The fuel injection system in accordance with claim 1, wherein the first control valve (60) is embodied as a 3/2-port directional-control valve, which can be switched back and forth only between the first and second switching positions.

3. The fuel injection system in accordance with claim 1, wherein the first control valve (160) is embodied as a 3/3-port directional-control valve, which can additionally be switched back and forth into a third switching position, in which the pump work chamber (22) communicates with the relief chamber (9; 21), and the pressure chamber (40) and the control pressure chamber (52) communicate with the relief chamber (9).

4. The fuel injection system in accordance with claim 1, wherein a relief chamber communication (70) of the control pressure chamber (52) with the relief chamber (9) is controlled by the second control valve (68); and wherein the control pressure chamber (52) has a control pressure chamber communication with the pressure chamber communication (54), the control pressure chamber communication leading away from the pressure chamber communication (54) of the pump work chamber (22) with the pressure chamber (40), downstream of the first control valve (60; 160).

5. The fuel injection system in accordance with claim 2, wherein a relief chamber communication (70) of the control pressure chamber (52) with the relief chamber (9) is controlled by the second control valve (68); and wherein the control pressure chamber (52) has a control pressure chamber communication with the pressure chamber communication (54), the control pressure chamber communication leading away from the pressure chamber communication (54) of the pump work chamber (22) with the pressure chamber (40), downstream of the first control valve (60; 160).

6. The fuel injection system in accordance with claim 3, wherein a relief chamber communication (70) of the control pressure chamber (52) with the relief chamber (9) is controlled by the second control valve (68); and wherein the control pressure chamber (52) has a control pressure chamber communication with the pressure chamber communication (54), the control pressure chamber communication leading away from the pressure chamber communication (54) of the pump work chamber (22) with the pressure chamber (40), downstream of the first control valve (60; 160).

7. The fuel injection system in accordance with claim 4, further comprising a throttle restriction (58; 71) in the relief chamber communication (70) of the control pressure chamber (52) with the relief chamber (9) and/or in the control pressure chamber communication (56) of the control pressure chamber (52) with the pressure chamber communication (54).

8. The fuel injection system in accordance with claim 4, wherein, at the onset of a pumping stroke of the pump piston (18), the first control valve (60) is put in its second switching position and the second control valve (68) is closed, so that fuel is pumped into the pressure chamber (40) and the control pressure chamber (52); wherein in the course of the pumping stroke of the pump piston (18), the first control valve (60; 160) is put in its first switching position; and wherein for at least one preinjection, the second control valve (68) is opened, so that the control pressure chamber (52) is relieved, and the injection valve member (28) opens in response to the pressure prevailing in the pressure chamber (40).

9. The fuel injection system in accordance with claim 7, wherein, at the onset of a pumping stroke of the pump piston (18), the first control valve (60) is put in its second switching position and the second control valve (68) is closed, so that fuel is pumped into the pressure chamber (40) and the control pressure chamber (52); wherein in the course of the pumping stroke of the pump piston (18), the first control valve (60; 160) is put in its first switching position; and wherein for at least one preinjection, the second control valve (68) is opened, so that the control pressure chamber (52) is relieved, and the injection valve member (28) opens in response to the pressure prevailing in the pressure chamber (40).

10. The fuel injection system in accordance with claim 8, wherein, for terminating the at least one preinjection, the second control valve (68) is closed, so that the injection valve member (28) closes in response to the pressure prevailing in the control pressure chamber (52).

11. The fuel injection system in accordance with claim 8, wherein the at least one preinjection is terminated once the pressure prevailing in the pressure chamber (40) has dropped so sharply that the injection valve member (28) closes in response to the closing force (44).

12. The fuel injection system in accordance with claim 11, wherein the first control valve (60; 160), in the pumping stroke of the pump piston (18), is kept for a defined length of time in its second switching position, in order to pump a defined fuel quantity into the pressure chamber (40) and the control pressure chamber (52), so that in the at least one preinjection until the instant of closure of the injection valve member (28), a defined fuel quantity is injected.

13. The fuel injection system in accordance with claim 11, wherein the pump piston (18) is driven by a cam (20); wherein the cam (20), in a first rotational angle range, has a shape determined in such a way that the pump piston (18) executes a defined pumping stroke and pumps a defined fuel quantity into the pressure chamber (40) and the control pressure chamber (52), which quantity is injected in the preinjection; and wherein in an ensuing rotational angle range, the cam (20) has a form determined in such a way that the pump piston (18) executes no further pumping stroke.

14. The fuel injection system in accordance with claim 11, wherein during the pumping stroke of the pump piston (18) after the at least one preinjection, the first control valve (60; 160) is put in its second switching position; wherein the second control valve (68) is closed; and wherein for a subsequent main injection the second control valve (68) is opened, so that the control pressure chamber (52) is relieved, and the injection valve member (28) opens in response to the pressure prevailing in the pressure chamber (40).

15. The fuel injection system in accordance with 8, wherein, during the pumping stroke of the pump piston (18) after the at least one preinjection, the first control valve (60; 160) is put in its second switching position; wherein the second control valve (68) is opened, so that the control pressure chamber (52) is relieved; and wherein a subsequent main injection is effected when the pressure generated by the pump piston (18) in the pressure chamber (40) is so high that in response to it, the injection valve member (28) opens counter to the closing force (44).

16. The fuel injection system in accordance with claim 14, wherein, for terminating the main injection, the second control valve (68) is closed.

17. The fuel injection system in accordance with claim 15, wherein, for terminating the main injection, the second control valve (68) is closed.

18. The fuel injection system in accordance with claim 14, wherein, after the main injection, at least one postinjection is effected; that in the preceding main injection, by closure of the second control valve (68) and switching of the first control valve (60; 160) into its first switching position, fuel under pressure is stored in the pressure chamber (40) and in the control pressure chamber (52); and wherein for the postinjection, the second control valve (68) is opened, so that the control pressure chamber (52) is relieved, and the injection valve member (28) opens in response to the pressure prevailing in the pressure chamber (40).

19. The fuel injection system in accordance with claim 15, wherein, after the main injection, at least one postinjection is effected; that in the preceding main injection, by closure of the second control valve (68) and switching of the first control valve (60; 160) into its first switching position, fuel under pressure is stored in the pressure chamber (40) and in the control pressure chamber (52); and wherein for the postinjection, the second control valve (68) is opened, so that the control pressure chamber (52) is relieved, and the injection valve member (28) opens in response to the pressure prevailing in the pressure chamber (40).

20. The fuel injection system in accordance with claim 16, wherein, after the main injection, at least one postinjection is effected; that in the preceding main injection, by closure of the second control valve (68) and switching of the first control valve (60; 160) into its first switching position, fuel under pressure is stored in the pressure chamber (40) and in the control pressure chamber (52); and wherein for the postinjection, the second control valve (68) is opened, so that the control pressure chamber (52) is relieved, and the injection valve member (28) opens in response to the pressure prevailing in the pressure chamber (40).

21. The fuel injection system in accordance with claim 14, wherein, after the main injection, at least one postinjection is effected; wherein for pressure generation for the postinjection, the first control valve (60; 160) is put in its second switching position; and wherein for the postinjection, the second control valve (68) is opened.

22. The fuel injection system in accordance with claim 15, wherein, after the main injection, at least one postinjection is effected; wherein for pressure generation for the postinjection, the first control valve (60; 160) is put in its second switching position; and wherein for the postinjection, the second control valve (68) is opened.

23. The fuel injection system in accordance with claim 16, wherein, after the main injection, at least one postinjection is effected; wherein for pressure generation for the postinjection, the first control valve (60; 160) is put in its second switching position; and wherein for the postinjection, the second control valve (68) is opened.

24. The fuel injection system in accordance with claim 14, wherein, after the main injection or the postinjection, at the end of an injection cycle, fuel is stored in the pressure chamber (40) and in the control pressure chamber (52), with the second control valve (68) closed and the first control valve (60; 160) disposed in its first switching position, at such a high pressure that this pressure is sufficient, in a subsequent injection cycle with the second control valve (68) opened, to perform the preinjection.

25. The fuel injection system in accordance with claim 15, wherein, after the main injection or the postinjection, at the end of an injection cycle, fuel is stored in the pressure chamber (40) and in the control pressure chamber (52), with the second control valve (68) closed and the first control valve (60; 160) disposed in its first switching position, at such a high pressure that this pressure is sufficient, in a subsequent injection cycle with the second control valve (68) opened, to perform the preinjection.

26. The fuel injection system in accordance with claim 16, wherein, after the main injection or the postinjection, at the end of an injection cycle, fuel is stored in the pressure chamber (40) and in the control pressure chamber (52), with the second control valve (68) closed and the first control valve (60; 160) disposed in its first switching position, at such a high pressure that this pressure is sufficient, in a subsequent injection cycle with the second control valve (68) opened, to perform the preinjection.

27. The fuel injection system in accordance with claim 14, wherein, after the main injection or the postinjection, at the end of an injection cycle, the second control valve (68) is opened when the pressure in the pressure chamber (40) has dropped so sharply as a consequence of leakage that the force generated by this pressure on the injection valve member (28) in the opening direction (29) is less than the closing force (44) acting the injection valve member (28).

28. The fuel injection system in accordance with claim 15, wherein, after the main injection or the postinjection, at the end of an injection cycle, the second control valve (68) is opened when the pressure in the pressure chamber (40) has dropped so sharply as a consequence of leakage that the force generated by this pressure on the injection valve member (28) in the opening direction (29) is less than the closing force (44) acting the injection valve member (28).

29. The fuel injection system in accordance with claim 16, wherein, after the main injection or the postinjection, at the end of an injection cycle, the second control valve (68) is opened when the pressure in the pressure chamber (40) has dropped so sharply as a consequence of leakage that the force generated by this pressure on the injection valve member (28) in the opening direction (29) is less than the closing force (44) acting the injection valve member (28).

30. The fuel injection system in accordance with claim 2, a relief chamber communication (70) of the control pressure chamber (52) with the relief chamber (9) is controlled by the second control valve (68); wherein the control pressure chamber (52) has a control pressure chamber communication with the pressure chamber communication (54), the control pressure chamber communication leading away from the pressure chamber communication (54) of the pump work chamber (22) with the pressure chamber (40), downstream of the first control valve (60; 160), and wherein the first control valve (160) is put in its third switching position upon termination of a fuel injection.

* * * * *